United States Patent [19]

Hazbun et al.

[11] Patent Number: 4,744,796

[45] Date of Patent: May 17, 1988

[54] MICROEMULSION FUEL SYSTEM

[75] Inventors: Edward A. Hazbun, Media; Steven G. Schon, Philadelphia; Roger A. Grey, West Chester, all of Pa.

[73] Assignee: ARCO Chemical Company, Newtown Square, Pa.

[21] Appl. No.: 825,841

[22] Filed: Feb. 4, 1986

[51] Int. Cl.[4] ..... C10L 1/32

[52] U.S. Cl. ..... 44/51; 44/53; 44/57

[58] Field of Search ..... 44/53, 56, 57, 51

[56] References Cited

U.S. PATENT DOCUMENTS

| | | | |
|---|---|---|---|
| 2,487,189 | 11/1949 | Smith et al. | 44/57 |
| 2,702,279 | 2/1955 | Funderburk et al. | 252/542 |
| 3,006,142 | 10/1961 | Carr | 44/53 |
| 4,002,435 | 1/1977 | Wenzel et al. | 44/53 |
| 4,300,912 | 11/1981 | Fownsend | 44/53 |
| 4,451,265 | 5/1984 | Schwab | 44/57 |
| 4,465,494 | 8/1984 | Bourrel et al. | 44/53 |
| 4,477,258 | 10/1984 | Lepain | 44/53 |
| 4,561,861 | 12/1985 | Davis et al. | 44/51 |
| 4,565,548 | 1/1986 | Davis et al. | 44/51 |
| 4,568,354 | 2/1986 | Davis et al. | 44/51 |
| 4,568,355 | 2/1986 | Davis et al. | 44/51 |
| 4,608,057 | 8/1986 | Davis et al. | 44/51 |

FOREIGN PATENT DOCUMENTS

| | | | |
|---|---|---|---|
| 0049921 | 4/1982 | European Pat. Off. | 44/53 |
| 56-0016792 | 9/1981 | Japan | 44/51 |
| 57-0038889 | 3/1982 | Japan | 44/51 |
| 58-0008793 | 1/1983 | Japan | 44/53 |

*Primary Examiner*—William R. Dixon, Jr.
*Assistant Examiner*—Margaret B. Medley
*Attorney, Agent, or Firm*—Graig E. Larson

[57] ABSTRACT

Stable microemulsion fuel compositions are provided which comprise (a) a hydrocarbon fuel such as diesel fuel, jet fuel, gasoline, or fuel oil; (b) water and/or methanol; and (c) a novel cosurfactant combination of tertiary butyl alcohol and an ionic or nonionic surfactant. The compositions of the invention exhibit a high degree of phase stability even over wide variations of temperature, greatly improved salt tolerance and reduce smoke particulate and $NO_x$ emissions.

12 Claims, 3 Drawing Sheets

FIGURE I

METHANOL CAPACITY vs NEUTRALIZATION WITH ETHANOL AMINES

DIESEL / METHANOL + GTBA / FATTY ACID

0°C

DIESEL / METHANOL / TBA / FATTY ACID MICROEMULSION PHASE DIAGRAM

25 °C

MICROEMULSION FUEL SYSTEM

BACKGROUND OF THE INVENTION

Field of the Invention

The invention relates to microemulsion fuel compositions, and especially to such compositions having improved stability. Microemulsion fuel compositions have been of considerable interest since the combustion characteristics of such fuels have been found to be considerably different from those of the unmodified base fuels. Differences in combustion have been attributed to the presence of low molecular weight immiscible compounds such as water or methanol in the fuel as well as to the structural changes which accompany micellization of the surfactants which have been employed. The beneficial combustion changes include decreased smoke, particulate, and $NO_x$ emissions, and increased combustion efficiency. Improved fire resistance has also been demonstrated for microemulsion fuels containing water.

Microemulsion fuels are clear, stable, two-phase dispersions which form on simple stirring under appropriate conditions. They are comprised of a continuous non-polar hydrocarbon phase and a discontinuous polar phase. Because of the small droplet size of the discontinuous phase (2 to 200 nanometers) these fuels appear to be clear, one-phase systems.

Discription of the Prior Art

The effects of water or alcohol addition on diesel engine performance is reviewed in "Water and Alcohol Use in Automotive Diesel Engines", DOE/CS/50286-4, published September 1985 by J. J. Donnelly, Jr. and H. M. White. The techniques for introducing water or alcohol into the engines covered by this review included (macro) emulsification, blending, fumigation, and dual-injection. The introduction of water or methanol was found to reduce emissions of smoke and particulates 20–60% while moderately reducing or increasing emissions of hydrocarbons and carbon monoxide. The addition of water also reduced levels of $NO_x$ 10–50%. This held true for all methods for introducing the water or methanol, and is attributed to a lowering of combustion temperatures (due to lower specific heating values and the heat absorbed to vaporize the water or alcohol droplets), and to a "microexplosion" phenomenon (the dispersed droplets vaporize explosively, more effectively atomizing the hydrocarbon fuel during combustion).

Water or methanol are most advantageously introduced into combustion engines when they are dispersed in the hydrocarbon fuel as a microemulsion. Since microemulsions are cear, stable, and pre-blended (prior to being stored in the fuel tanks), there is no need for additional equipment on the vehicle (as would be required for the other methods) such as additional fuel metering systems (dual-injection), agitators inside the fuel tanks (to prevent separation of macroemulsion fuels), injection or fumigation devices, etc. At the same time, the water or alcohol is still introduced into the engine in the desired physical form, i.e., as microscopically fine liquid droplets (albeit dispersed as micelles in the hydrocarbon), preserving the ability to vaporize in the desired "microexplosion" manner.

An excellent general treatment of the subject of microemulsion fuel compositions is "microemulsion Fuels: Development and Use" ORNL TM-9603, published March 1985 by A. L. Compere et al. Again, the presence of water or methanol (in microemulsions) led to large reductions in smoke and particulates, with slight increases in hydrocarbons and CO emissions. Depending on the type of engine used and operating conditions, $NO_x$ emissions were moderately decreased or increased.

Research sponsored by the U.S. Army Fuels and Lubricants Research Laboratory investigated the effect of water-in-fuel microemulsions on the fire-safeness of combat fuels. Several reports by W. D. Weatherford, Jr. and co-workers (AFLRL reports Nos. 111, 130, and 145) document the effectiveness of microemulsion diesel fuels containing 1–10% water in reducing the flammability-fuel pools were either self-extinguishing following ignition, or could not be ignited by an open flame. The Army formulations were prepared with deionized water, and surfactants without the addition of alcohols as cosurfactants. If low levels (200–500 ppm) of dissolved salts were present in the water, stable microemulsions could be formulated only by substantially increasing the percentage of surfactants, or by increasing the aromatic hydrocarbon content of the fuel. Even then, the amount of water that could be incorporated into the fuels was reduced when salts were present.

Various patents have issued which relate to microemulsion fuel compositions and which specifically relate to compositions comprised of hydrocarbon fuel, water, various alcohols, and surfactants. U.S. Pat. No. 4,406,519 for example, teaches a microemulsion fuel comprised of gasoline, methanol, water, and a surfactant blend having a hydrophilic-lipophilic balance value of 3 to about 4.5. U.S. Pat. No. 4,083,698 describes fuel compositions which are water-in-oil emulsions and which comprise a hydrocarbon fuel such as gasoline or diesel fuel, water, a water-soluble alcohol such as methanol, ethanol or isporpoanol, and certain combinations of surface-active agents. U.S. Pat. No. 4,451,265 describes microemulsion fuel compositions prepared from diesel fuel, water, lower water-miscible alcohols, and a surfactant system comprising N,N-dimethyl ethanolamine and a long-chain fatty acid substance. U.S. Pat. No. 4,451,267 teaches microemulsions prepared from vegetable oil, a $C_1$–$C_3$ alcohol, water and a lower trialkyl amine surfactant. This patent teaches the optional addition of 1-butanol as a cosurfactant for the purpose of lowering both the viscosity and the solidification temperature of the microemulsion.

A disadvantage of prior microemulsion fuel compositions has been a lack of stability under conditions to which the fuels have been exposed. Prior compositions for example, have been unstable and have tended to de-emulsify at high and at low temperatures; high temperature de-emulsification has been a special problem. Further, the addition of even very small amounts of salt as by exposure to salt-containing air or water has caused severe de-emulsification problems in prior formulations that did not contain alcohols

SUMMARY OF THE INVENTION

In accordance with the present invention, microemulsion fuel stability is enhanced while the advantageous characteristics of the fuel are retained by incorporating in the microemulsion formulation an effective amount of tertiary butyl alcohol as a cosurfactant. Thus, the novel fuel composition of this invention comprises (a) a hydrocarbon fuel such as diesel fuel, jet fuel, gasoline fuel oil or the like; (b) water and/or methanol; and (c) a cosurfactant system of tertiary butyl alcohol in combination with one or more of an amphoteric, cationic, anionic or nonionic surface active agent.

THE DRAWINGS

FIG. 1 graphically illustrates the amount of methanol which can be incorporated in diesel fuel using fatty acid and tertiary butyl alcohol cosurfactants as a function of the degree of neutralization of the fatty acid.

FIGS. 2 and 3 are phase diagrams of diesel fuel, methanol, fatty acid, and tertiary butyl alcohol systems at 0° C. and 25° C.

DETAILED DESCRIPTION

Figure 1:
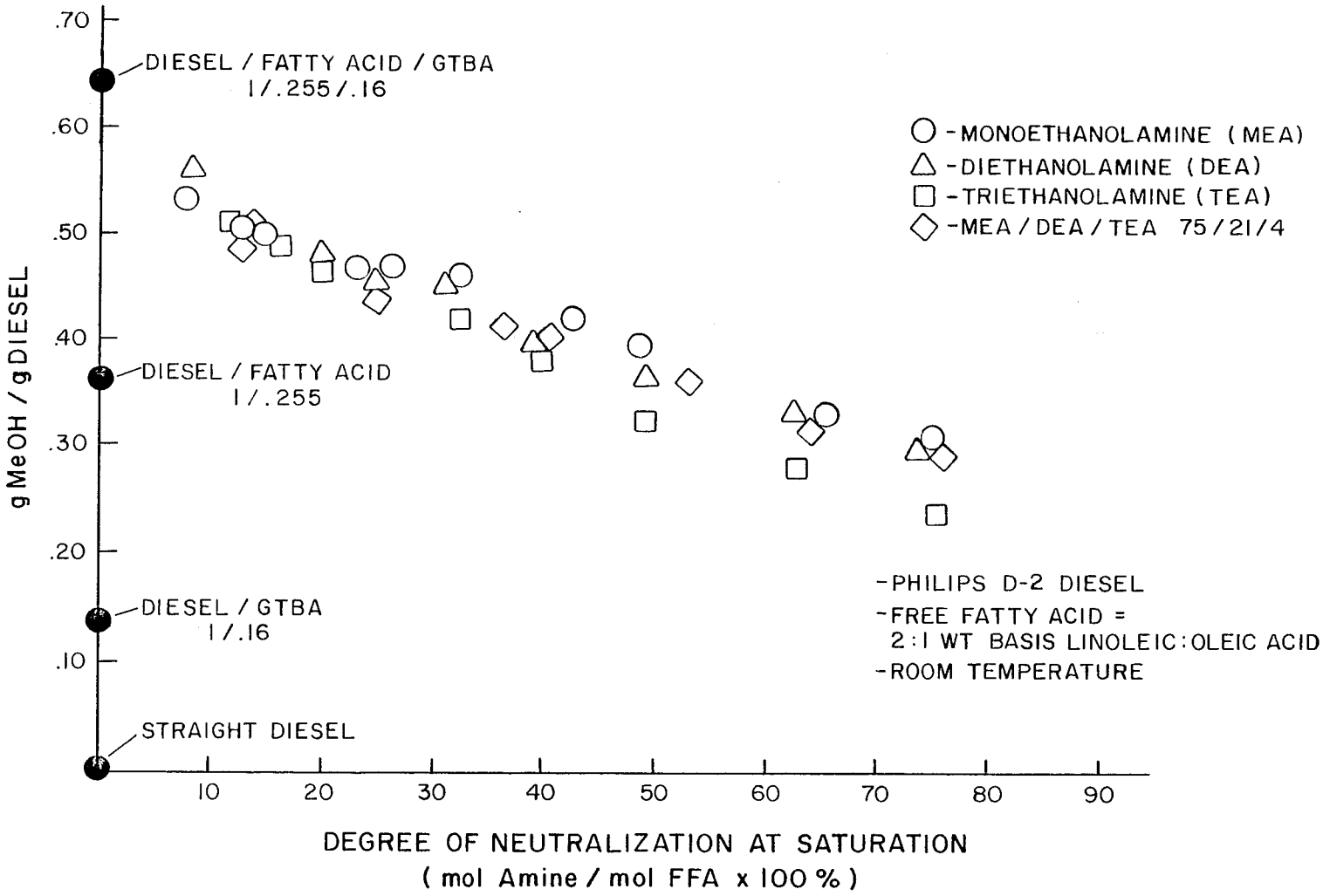

It has now been found that the stability, and thus the utility, of microemulsion fuels can be substantially improved by incorporation in the microemulsion formulation of an effective amount of tertiary butyl alcohol as a cosurfactant. Microemulsion diesel fuels, for example, retain their characteristics of decreased particulate and $NO_x$ emissions by virture of the added water and/or methanol, while demonstrating enhanced stability, especially at higher temperatures. Fireresistant fuels containing water likewise retain their advantageous characteristics of reducing or eliminating burning while demonstrating vast improvement in the critical area of salt tolerance.

The present invention is applicable generally to fuels which have previously been prepared in microemulsion form. Predominate among such fuels have been microemulsion diesel fuel formulations. However, the invention is applicable as well to microemulsions of jet fuel, fuel oil, gasoline, and the like.

The microemulsion fuel compositions of the invention are clear and stable and exhibit the single phase properties of hydrocarbon fuels. The fuel hydrocarbons comprise a continuous oil phase with water and/or methanol and soluble components as the dispersed phase.

Fuel hydrocarbons which form the continuous phase comprise mixtures of hydrocarbons such as those derived from petroleum. Diesel fuel hydrocarbons are preferred but the invention is also applicable to microemulsions formed of jet fuel hydrocarbons, fuel oil hydrocarbons, gasoline hydrocarbons and the like. Compositions of the invention are readily used in place of the corresponding hydrocarbon fuels without the need for substantial changes in combustion apparatus, and demonstrate significantly improved stability characteristics over closely analagous prior compositions while retaining the important advantages demonstrated by prior formulations.

Fuel hydrocarbons comprise the predominant component of the microemulsion formulation. Generally speaking, the hydrocarbons comprise at least 50% by weight of the microemulsions and preferably comprise 60 to 90% by weight thereof.

Water and/or methanol forms a second essential component of the formulations of the invention, generally in amounts of 0.5 to 40% by weight, preferably about 3 to about 30% by weight, and more preferably about 5 to about 25% by weight. Larger amounts of water and/or methanol further reduce emissions, but adversely effect stability and power.

Essential to the invention is the provision of a cosurfactant composition comprising tertiary butyl alcohol in combination with an amphoteric, cationic, anionic or nonionic surfactant. Generally speaking, the invention involves modifying prior microemulsion formulations by the addition thereto or substitution therein of tertiary butyl alcohol preferably in amounts of 1 to 30% by weight of the microemulsion and more preferably in amounts of 3 to 20% by weight.

The weight ratio of water to tertiary butyl alcohol ranges from 1:10 to 5:1; preferred weight ratios range from 1:4 to 2:1 water:tertiary butyl alcohol. The weight ratio of methanol to tertiary butyl alcohol ranges from 1:4 to 10:1; preferred weight ratios range from 1:3 to 4:1 methanol:tertiary butyl alcohol.

High purity tertiary butyl alcohol can be used in the invention. However, less pure grades can also be used, especially those containing water and small amounts of organic impurities such as isopropyl alcohol and acetone.

The tertiary butyl alcohol is used in combination with surface active materials conventionally used in microemulsion formulations. Such conventional surface active materials are amphoteric, anionic, cationic or nonionic materials. Generally, these materials are used in amounts of 1 to 25% by weight of the microemulsion, preferably 3 to 20% by weight.

Amphoteric surface active materials preferably possess the betaine structure shown below.

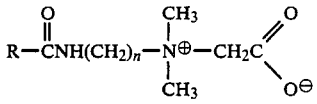

n=1-6 preferably 2 and 3 where $R=C_{11}-C_{17}$.

The cocoamidobetaines ($R=C_{11}$) available commercially are obtained as aqueous solutions containing 6% sodium chloride. For testing purposes, water and sodium chloride were removed before use. A typical formulation comprised by weight 65% No. 2 diesel fuel hydrocarbons, 5% water, 20% tertiary butyl alcohol, and 10% cocoamidobetaine demonstrated excellent stability over a wide range of temperatures. A betaine derived from oleic acid (unsaturate $C_{18}$ acid) gave similar good results.

Suitable nonionic surface active agents include ethoxylated alcohol derivatives, ethoxylated alkylphenols, pluronics and polyethoxylated carboxylate esters. Of the nonionics, the ethoxylated long chain primary alcohols were the most effective. A representative ethoxylated alcohol structure is shown below.

$$C_{12}H_{25}OCH_2CH_2OCH_2CH_2OCH_2CH_2OCH_2CH_2OCH_2CH_2OCH_2CH_2OH$$

Ethoxylated alcohols having HLB's (hydrophilic/lipophilic balance) from 7.9 to 14.4 were evaluated as surfactants.

An example formulation consisted by weight of 45.8% diesel, 7.2% water, 40% t-butanol (TBA), and 7% Neodol 23-6.5 (HLB=12.0). Neodol 23-6.5 is a Shell trademark for a mixture of $C_{12}-C_{13}$ linear primary alcohol ethoxylates with an average of 6.5 ethylene oxide units per mole of alcohol.

Cationic surfactants which can be used include quaternary ammonium salt derivatives of the structures shown below.

Q1

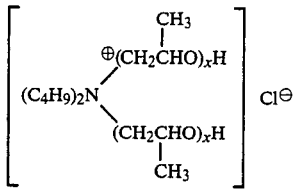

x = 5 – 10

Q2

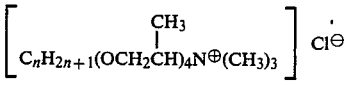

n = mixtures of 6 and 10 or 8 and 10 or 16 and 18

Q3

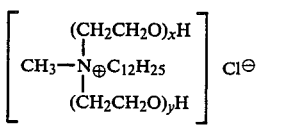

y + x = 15

Q4

$[C_{12}H_{25}N^{\oplus}(CH_3)_3]\ Cl^{\ominus}$

The cationics Q1 and Q2 represent propylene oxide derivatives of various quaternary ammonium compounds. They can be employed, for example, as the chloride or acetate salts. A Q2 type surfactant where the linear primary alcohol was $C_{16}$–$C_{18}$ mixture of alcohols, having an average of four propylene oxide units attached and terminated with a quaternary ammonium group gave good results. A microemulsion comprised by weight of 75% No. 2 diesel hydrocarbons, 5% water, 10% tertiary butyl alcohol, and 10% of the Q2 surfactant was stable over a wide range of temperatures. Structures Q1 and Q3 were not as effective as structures Q2 and Q4 with Q4 being the most effective cationic surfactant.

Anionic surfactants are long chain carboxylic acids (i.e., fatty acids) which can be neutralized to varying degrees. For example, oleic acid, linoleic acid, stearic acid, and isostearic acid, linolenic acid and palmitic acid and the like can be employed. As known in the art, neutralizing agents such as alkanol amines and inorganic bases may be employed.

EXAMPLES

When anionic surfactants are employed in water-containing microemulsion fuels of this invention, uptake of water may be maximized by partially neutralizing the fatty acids: the degree of neutralization is preferably about 30 to about 65 mole %. When anionic surfactants are employed in methanol-containing microemulsion fuels of this invention, uptake of methanol may be maximized by using unneutralized fatty acids (as illustrated in FIG. 1).

Water-containing microemulsion fuels preferably contain about 1 to about 20 (more preferably about 4 to about 12) % by weight tertiary butyl alcohol, and about 2 to about 20 (more preferably about 5 to about 15) % by weight of at least one amphoteric, anionic, cationic or nonionic surfactant. Methanol-containing microemulsion fuels preferably contain about 5 to about 30 (more preferably about 10 to about 20) % by weight methanol, about 5 to about 30 (more preferably 10 to about 20) % by weight tertiary butyl alcohol, and about 3 to about 20 (more preferably about 7 to about 17) % by weight of at least one amphoteric, anionic, cationic or nonionic surfactant.

The following examples illustrate the invention. In these examples the diesel fuel used conformed to the Standard Specification as determined by the American Society for Testing and Matierals for diesel fuel oil No. 2. The tertiary butyl alcohol used was gasoline grade tertiary butyl alcohol and contained 1% by weight water as determined by Karl Fisher analysis. Unless otherwise indicated, parts and percentages are by weight.

In the examples described in the following sections, the microemulsions were prepared at room temperature by pipetting the desired amounts of each component into a 16×150 mm culture tube and weighing, using an electronic analytical balance. Norminally 10 grams of each formulation was prepared. The components were added in the following order: (1) diesel fuel, (2) surfactant, (3) water or methanol, and (4) tertiary butyl alcohol. The tubes were capped and shaken by hand after a component was added to the tube, before adding the next component. While the order of addition is convenient for laboratory-scale formulations, it is not necessarily optimal for formulating bulk quantities of the microemulsions. (The preferred sequence for bulk formulations is to prepare a mixture of the fuel and surfactant, and another mixture of the tertiary butyl alcohol and water or methanol. The alcoholic mixture is then added to the diesel/surfactant mixture under mild agitation. Other mixing sequences may result in the formation of soap globules or gels which are difficult to disperse.)

The culture tubes containing the microemulsions were placed in thermostated oil baths maintained at −20°, −10°, 0°, 20°, 48°, or 70° C. The tubes were inspected daily for phase behavior. Those that remained a single transparent phase at a given temperature for two weeks were deemed to be "stable" microemulsions at that temperature. If, over the course of two weeks a formulation exhibited turbidity, or if several layers or phases appeared, the microemulsion was deemed to be "unstable" at that temperature.

I. Examples Using Tertiary Butyl Alcohol, Deionized Water and Cationic, Nonionic, Amphoteric, or Anionic Surfactants in Diesel Microemulsions Table 1 gives the compositions and temperature stability for various w/o microemulsions formulated with diesel fuel, clean deionized water (<2 ppm dissolved solids), tertiary butyl alcohol, and various classes of surfactants. Examples 1–4 are formulated with "Arquad" (Armak Chemicals), a quaternary ammonium salt of tallow derived alkyl trimethyl ammonium chloride, or the "Epal" (Ethyl Corp.) derived cationic surfactants Q2(vide supra). The Arquad materials were vacuum evaporated to remove the isopropanol solvent. Examples 5 and 6 were formulated with "Neodol" (Shell Chemical Co.) or "Surfynol" (Air Products) nonionic surfactants. The "Surfynol" was the ethoxylated derivative of 2,4,7,9 tetra methyl 5 decyn-4,7 diol having an average of 10 ethylene oxide units per molecule. Examples 7–10 were formulated with "Emery 5430" or "Emery 6748" (Emery Industries) cocoamidobetaines. The betaines were first dewatered by azeotropic distillation with isopropanol that was added to the crude betaine, followed by vacuum evaporation to remove residual solvent. Salts were removed from the dewatered betaine by dissolution in isopropanol, heating overnight at 5° C. with stirring, and filtering through a medium glass frit packed with celite. The filtrate was evaporated under vacuum to remove the isopropanol from the betaine. Examples 11–20 were formulated with "Emersol 315" (Emery Industries) soy derived linoleic/oleic/linolenic fatty acid mixtures or with reagent grade linoleic or oleic acids (Fisher Scientific). The fatty acids were partially or fully neutralized with various alkanolamines, sodium hydroxide, or ammonium hydroxide.

As can be seen from the examples, the microemulsions formulated with tertiary butyl alcohol were stable over wide ranges of temperatures, from as low as −20° C. up to +70° C.; the minimum stable temperature span was 30° C. (e.g., from −10° to +20° C.), with 80° C. spans (e.g., from −10° to +70° C. being typical). The same formulations without the addition of tertiary butyl alcohol did not form microemulsions at any temperature; instead turbid macroemulsions or multiple phases appeared.

The stability at temperatures below 0° C. is unexpected, since this is below the freezing point of both the water and the tertiary butyl alcohol. The prior art (e.g., U.S. Pat. No. 4,083,698) claims that $C_1$–$C_3$ alcohols are necessary for low temperature stability, since they have lower freezing points than the water or the diesel fuel cloud point. In contrast, both water and tertiary butyl alcohol freeze at temperatures above the cloud point of diesel (typically −15° to −5° C.), yet the microemulsions formulated with these ingredients are clear, stable, and free-flowing low viscosity liquids at −10° C.

TABLE 1

| | | Weight Percent Composition | | | | Temperature Stability (°C.) | | | | | |
|---|---|---|---|---|---|---|---|---|---|---|---|
| Example No. | Surfactant | Phillips D-2 Diesel Control Fuel | Surfactant | Deionized Water | TBA | −20 | −10 | 0 | 20 | 48 | 70 |
| | Cationics | | | | | | | | | | |
| 1 | Arquad T-50 | 70.3 | 9.4 | 4.8 | 15.5 | − | + | + | + | + | + |
| 2 | Arquad T-50 | 57.1 | 7.8 | 7.6 | 25.5 | − | − | − | + | + | + |
| | (Epal-810) Q2 | 75.0 | 10.0 | 5.0 | 10.0 | − | − | − | + | + | + |
| 4 | (Epal 16/18) Q2 | 75.0 | 10.0 | 5.0 | 10.0 | − | + | + | + | + | − |
| | Nonionics | | | | | | | | | | |
| 5 | Neodol 23-65 | 45.8 | 7.0 | 7.2 | 40.0 | − | − | − | + | + | + |
| 6 | Surfynol-465 | 52.2 | 7.5 | 3.8 | 36.5 | − | − | − | + | + | + |
| | Amphoterics | | | | | | | | | | |
| 7 | Emery 5430 | 63.0 | 8.4 | 4.2 | 24.3 | − | − | + | + | + | + |
| 8 | Emery 5430 | 48.5 | 6.9 | 6.9 | 37.7 | − | − | − | + | + | + |
| 9 | Emery 6748 | 65.7 | 8.8 | 4.4 | 21.0 | + | + | + | + | + | + |
| 10 | Emery 5430 | 65.0 | 10.0 | 5.0 | 20.0 | − | + | + | + | + | + |
| | Anionics | | | | | | | | | | |
| | Emersol 315, 100% neutralized with monoethanolamine | 75.0 | 9.2 | 5.0 | 10.0 | − | + | + | + | − | − |
| 12 | Emersol 315, 100% neutralized with monoethanolamine | 71.6 | 12.8 | 5.1 | 10.5 | − | + | + | + | + | − |
| 13 | Emersol 315, 100% neutralized with dimethylethanolamine | 74.6 | 10.4 | 5.0 | 10.0 | − | + | + | + | − | − |
| 14 | Emersol 315, 40% neutralized with dimethylethanolamine | 73.6 | 11.3 | 5.1 | 10.0 | − | + | + | + | + | + |
| 15 | Emersol 315, 100% neutralized with NaOH | 75.0 | 10.0 | 5.0 | 10.0 | − | + | + | + | + | + |
| 16 | Emersol 315, 40% neutralized with NaOH | 70.0 | 10.0 | 5.0 | 10.0 | − | + | + | + | + | + |
| 17 | Oleic Acid, 100% neutralized with monoethanolamine | 71.6 | 12.8 | 5.1 | 10.5 | − | + | + | + | + | + |
| 18 | Emersol 315, 40% neutralized with monoethanolamine | 54.0 | 20.8 | 20.0 | 5.2 | − | − | + | + | − | − |
| 19 | Emersol 315, 40% neutralized with monoethanolamine | 62.0 | 18.0 | 10.0 | 10.0 | − | + | + | + | + | + |
| 20 | 2:1 Linoleic:Oleic Acids, 50% neutralized with monoisopropanolamine | 62.0 | 18.0 | 10.0 | 10.0 | − | + | + | + | + | + |
| 21 | Emersol 315, 60% neutralized with $NH_4OH$ | 60 | 20.0 | 25.0 | 5.0 | − | − | − | + | − | − |

Legend:
+ denotes stable microemulsion
− denotes instability (multiple phases or cloudiness)

II. Examples Using TBA, Water Containing Dissolved Salts, and Anionic or Amphoteric Surfactants in Diesel Microemulsions Table 2 gives the compositions and temperature stability for various w/o microemulsions formulated with diesel fuel, water containing dissolved sodium or calcium chloride, TBA, and anionic or amphoteric surfactants. Examples 22–24 are formulated with "Emersol 610" (Emery Industries) soy-derived linoleic/oleic/palmitic fatty acid mixtures, neutralized with monoethanolamine. Examples 27–28 are formulated with "Emery 6748" (Emery Industries) cocoamidobetaines, which were purified in the manner described in the preceding section.

The examples demonstrate the greatly improved salt tolerance and temperature stability of microemulsions formulated with TBA. Salt concentrations of 0.5–5 wt. % in the water were tolerated, while maintaining stability over temperatures ranging from −10° to 70° C.

with nonionic surfactant. Examples 31–34 were formulated with the anionic surfactants. The temperature stabilities of the formulations containing NBA v. TBA are compared in Table 3.

In all of these examples, the microemulsions formulated with TBA had a wider range of temperature stability than the corresponding microemulsions that were formulated with NBA. This was true when the water: alcohol ratio exceeded 1:4 by weight. In other experiments at lower water:alcohol ratios, the temperature stability of the TBA formulations showed no significant improvement compared to NBA. The higher ratios are advantageously employed since it is desired to maximize the water loading, and minimize the surfactant-/cosurfactant loading.

TABLE 2

| Example No. | Surfactant | Wt. % Salt in Water | Weight Percent Composition: Phillips D-2 Diesel Control Fuel | Surfactant | Water | TBA | Temperature Stability (°C.) −20 | −10 | 0 | 20 | 48 | 70 |
|---|---|---|---|---|---|---|---|---|---|---|---|---|
| | Anionics | | | | | | | | | | | |
| 22 | Emersol 610, 100% neutralized with monoethanolamine | 2% NaCl | 73.2 | 11.8 | 5.0 | 10.0 | − | + | + | + | + | + |
| 23 | Emersol 610, 100% neutralized with monoethanolamine | 5% NaCl | 73.2 | 11.8 | 5.0 | 10.0 | − | + | + | + | + | + |
| 24 | Emersol 610, 100% neutralized with monoethanolamine | 1% $CaCl_2$ | 73.2 | 11.8 | 5.0 | 10.0 | − | + | + | + | + | + |
| 25 | Emersol 315, 100% neutralized with monoethanolamine | 1% $NaCl_2$ | 73.2 | 11.8 | 5.0 | 10.0 | − | + | + | + | − | − |
| 26 | Emersol 315, 100% neutralized with monoethanolamine | 0.5% $CaCl_2$ | 73.2 | 11.8 | 5.0 | 10.0 | − | + | + | + | − | − |
| | Amphoterics | | | | | | | | | | | |
| 27 | Emery 6748 | 1.0% NaCl | 65.9 | 8.9 | 4.4 | 20.8 | − | + | + | + | − | − |
| 28 | Emery 6748 | 0.5% $CaCl_2$ | 65.6 | 8.8 | 4.3 | 21.1 | − | + | + | + | + | + |

Legend:
+ denotes stable microemulsion
− denotes instability (multiple phases or cloudiness)

III. Examples Showing the Superiority of TBA Compared to NBA in Diesel Microemulsions The prior art teaches that n-butanol (NBA) is the preferred alcohol for microemulsions using alcohols as the cosurfactant. The following examples demonstrate the superiority of TBA compared to NBA in various w/o hydrocarbon microemulsions.

Selected formulations (examples 3, 5, 12, 14, 15, and 17) from the examples of Section I were kept the same, except that reagent grade NBA (Fisher Scientific) was substituted for TBA. Example 29 was formulated with the cationic surfactant. Example 30 was formulated

TABLE 3

| Example No. | Surfactant | Weight Percent Composition: Phillips D-2 Diesel Control Fuel | Surfactant | Deionized Water | Alcohol | Alcohol | Temperature Stability (°C.) −10 | 0 | 20 | 48 | 70 |
|---|---|---|---|---|---|---|---|---|---|---|---|
| | Cationics | | | | | | | | | | |
| 29 | (Epal-810) Q2 | 75.0 | 10.0 | 5.0 | 10.0 | NBA | − | − | + | − | − |
| 3 | | | | | | TBA | − | − | + | + | + |
| | Nonionics | | | | | | | | | | |
| 30 | Neodol 23-6.5 | 45.8 | 7.0 | 7.2 | 40.0 | NBA | − | − | − | − | − |
| 5 | | | | | | TBA | − | − | + | + | + |
| | Anionics | | | | | | | | | | |
| 31 | Emersol 315, 100% | 71.6 | 12.8 | 5.1 | 10.5 | NBA | + | + | + | − | − |
| 12 | neutralized with monoethanolamine | | | | | TBA | + | + | + | + | − |
| 32 | Emersol 315, 40% | 73.6 | 11.3 | 5.1 | 10.0 | NBA | − | + | + | + | + |
| 14 | neutralized with dimethylethanolamine | | | | | TBA | + | + | + | + | + |
| 33 | Emersol 315, 100% | 75.0 | 10.0 | 5.0 | 10.0 | NBA | + | + | + | − | − |
| 15 | neutralized with NaOH | | | | | TBA | + | + | + | + | + |
| 34 | Oleic Acid, 100% | 71.6 | 12.8 | 5.1 | 10.5 | NBA | + | + | + | + | − |
| 17 | neutralized with monoethanolamine | | | | | TBA | + | + | + | + | + |

Legend:
+ denotes stable microemulsion
− denotes instability (multiple phases or cloudiness)

IV. Examples Using TBA, Methanol and Anionic Surfactants in Diesel Microemulsions Methanol is essentially insoluble in diesel fuel, its solubility being less than about 2 wt. %. It is known to those skilled in the art that methanol can be solubilized in diesel by adding TBA as a cosolvent. Mixtures of TBA and diesel are mutually soluble in all proportions, as are mixtures of TBA and methanol. However, relatively large amounts of TBA are required to solubilize the methanol in diesel—when the methanol: TBA weight ratio exceeds approximately 1:2 at 25° C., and 2:5 at 0° C., the solubility of the alcohol mixture in diesel fuel is limited, to a maximum of 2–23 wt. % total alcohols, diminishing with increasing methanol:TBA ratio or decreasing temperature.

It was discovered that methanol could be substituted for water in microemulsions formulated with diesel fuel, TBA, and anionic (fatty acid) surfactants. It was further discovered that the amount of methanol that could be solubilized in the presence of fatty acid and TBA together (Example 35*c*) is greater than the sum of the amount of methanol solubilizable in diesel/fatty acid mixtures (Example 35*b*) plus the amount of methanol solubilizable in diesel/TBA mixtures (Example 35*a*). An example is given in Table 4 wherein the fatty acid is a 2:1 weight ratio of linoleic to oleic acids (unneutralized).

Example 35*c* also illustrates the efficacy of small amounts of fatty acids to incorporate large volumes of total alcohol into diesel at high methanol:TBA ratios.

Figure 2:
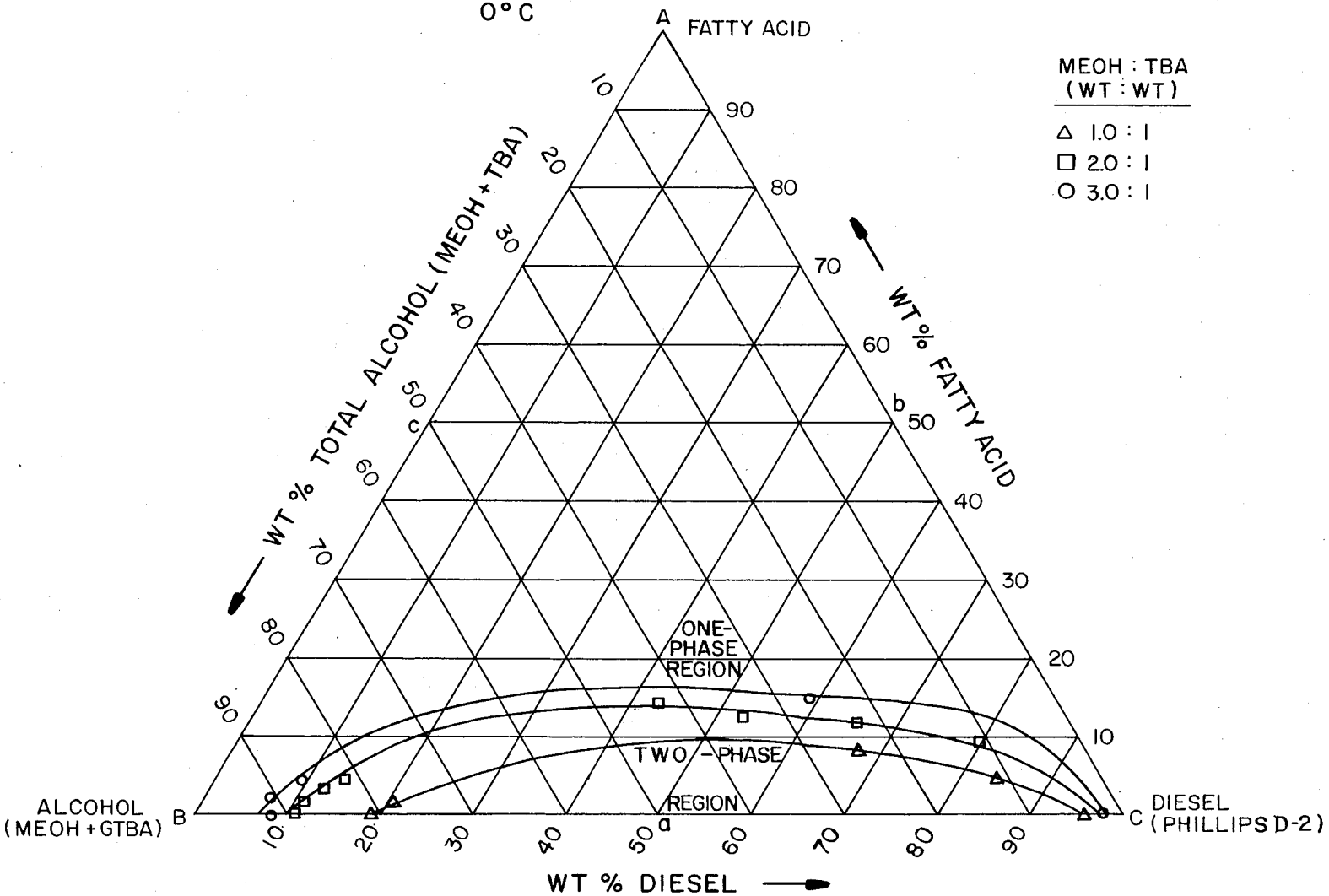
Figure 3:
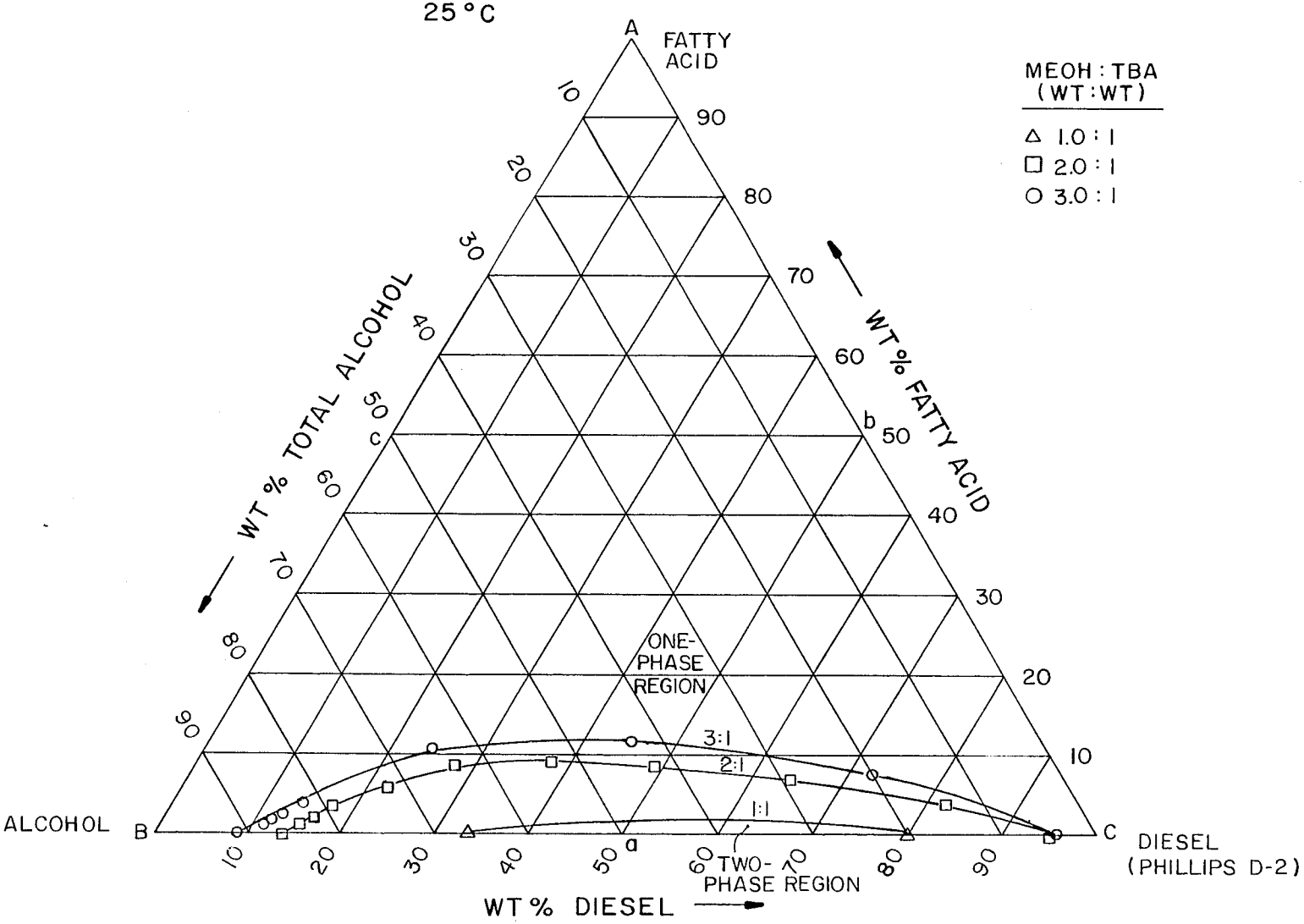

FIGS. 2 and 3 show the phase diagrams for diesel/-methanol/TBA/fatty acid systems at 0° and 25° C. at methanol:TBA weight ratios of 1:1, 2:1, and 3:1. The fatty acid used in these examples was Emersol 315. These diagrams show that relatively small amounts of fatty acid surfactant are requred to incorporate large amounts of methanol/TBA in diesel fuel, even at very high methanol:TBA ratios.

TABLE 4

| Example No. | Weight Ratios Before Methanol Addition (Diesel:TBA: Fatty Acid) | Uptake of Methanol (g Methanol/ 100 g Diesel) | Uptake of Total Alcohol (Wt. % In Final Mixtures) | Methanol: TBA Ratio at Maximum Uptake |
|---|---|---|---|---|
| 35a | 1:0.16:0 | 13 | 22.5 | 0.81 |
| 35b | 1:0:0.255 | 36 | 22.3 | No TBA |
| 35c | 1:0.16:0.255 | 64 | 38.9 | 4.0 |

We claim:

1. A microemulsion fuel composition comprising:
(a) a jet fuel, fuel oil or diesel hydrocarbon fuel;
(b) about 3.0 to about 40% by weight water and/or methanol; and
(c) a surface active amount of a combination of surface active agents consisting of: (1) tertiary butyl alcohol; and (2) at least one amphoteric; anionic, cationic or nonionic surfactant.

2. The composition of claim 1 wherein the hydrocarbon fuel is a diesel hydrocarbon fuel.

3. The composition of claim 1 wherein the water:-TBA ratio is about 1:10 to about 5:1.

4. The composition of claim 1 wherein the methanol:-TBA ratio is about 1:4 to about 10:1.

5. The composition of claim 1 wherein the surfactant is an amphoteric betaine.

6. A microemulsion fuel comprising:
(a) a jet fuel, fuel oil or diesel hydrocarbon fuel;
(b) about 3 to about 40% by weight water;
(c) about 1 to about 20% by weight tertiary butyl alcohol; and
(d) about 2 to about 20% by weight of at least one amphoteric, anionic, cationic or nonionic surfactant.

7. The composition of claim 6 wherein the hydrocarbon fuel is a diesel hydrocarbon fuel.

8. The composition of claim 6 wherein the surfactant is a partially neutralized fatty acid or fatty acid mixture.

9. The composition of claim 8 wherein the degree to which the fatty acid or fatty acid mixture is neutralized is about 30 to about 65 mole %.

10. A microemulsion fuel comprising:
(a) a jet fuel, fuel oil or diesel hydrocarbon fuel;
(b) about 5 to about 30% by weight methanol;
(c) about 5 to about 30% by weight tertiary butyl alcohol; and
(d) about 3 to about 20% by weight of at least one amphoteric, anionic, cationic or nonionic surfactant.

11. The composition of claim 10 wherein the hydrocarbon fuel is a diesel hydrocarbon fuel.

12. The composition of claim 10 wherein the surfactant is a substantially non-neutralized fatty acid or fatty acid mixture.

* * * * *